US009882290B2

(12) United States Patent
Shinohara et al.

(10) Patent No.: US 9,882,290 B2
(45) Date of Patent: Jan. 30, 2018

(54) CRIMP TERMINAL

(71) Applicant: Yazaki Corporation, Tokyo (JP)

(72) Inventors: Junya Shinohara, Shizuoka (JP); Masashi Iwata, Shizuoka (JP); Kazuto Ohtaka, Shizuoka (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 15/380,199

(22) Filed: Dec. 15, 2016

(65) Prior Publication Data

US 2017/0179620 A1 Jun. 22, 2017

(30) Foreign Application Priority Data

Dec. 16, 2015 (JP) ..... 2015-244886

(51) Int. Cl.
*H01R 4/48* (2006.01)
*H01R 4/18* (2006.01)
(Continued)

(52) U.S. Cl.
CPC ..... *H01R 4/185* (2013.01); *H01R 43/0482* (2013.01); *H01R 43/055* (2013.01); *H01R 2101/00* (2013.01)

(58) Field of Classification Search
CPC ..... H01R 2101/00; H01R 43/055; H01R 43/0482; H01R 4/185
(Continued)

(56) References Cited

U.S. PATENT DOCUMENTS 4,973,271 A * 11/1990 Ishizuka ..... H01R 13/193 439/833
6,447,345 B2 * 9/2002 Sato ..... H01R 43/16 439/842
(Continued)

FOREIGN PATENT DOCUMENTS

JP 2002-184479 A 6/2002
JP 2012-069449 A 4/2012
(Continued)

OTHER PUBLICATIONS

English translation of Office Action dated Oct. 31, 2017 in Japanese patent application No. 2015-244886.

*Primary Examiner* — Abdullah Riyami
*Assistant Examiner* — Nelson R Burgos-Guntin
(74) *Attorney, Agent, or Firm* — Sughrue Mion, PLLC

(57) ABSTRACT

A crimp terminal includes a terminal connecting portion, an electric wire connecting portion, and a coupling portion. The electric wire connecting portion is formed with a first barrel piece and a second barrel piece, the two facing each other, by bending processing on an electric wire side plate-shaped portion after two facing walls are formed by bending processing on a terminal side plate-shaped portion. The coupling portion is formed with two facing side walls by bending processing on a coupling side plate-shaped portion. Certain portions that will be the side walls later are formed with at least one tensile force absorbing portion that absorbs a tensile force between the terminal side plate-shaped portion side and the electric wire side plate-shaped portion side occurring during the bending processing on the terminal side plate-shaped portion.

6 Claims, 8 Drawing Sheets

(51) Int. Cl.
*H01R 43/048* (2006.01)
*H01R 43/055* (2006.01)
*H01R 101/00* (2006.01)

(58) Field of Classification Search
USPC ..... 439/839, 842, 852, 851, 850, 856, 857
See application file for complete search history.

(56) References Cited

U.S. PATENT DOCUMENTS

| | | | | |
|---|---|---|---|---|
| 2002/0077001 | A1 | 6/2002 | Chen | |
| 2005/0227551 | A1* | 10/2005 | Tabata | H01R 13/113 439/852 |
| 2006/0035538 | A1* | 2/2006 | Suemitsu | H01R 13/187 439/852 |
| 2013/0288546 | A1 | 10/2013 | Okano et al. | |
| 2015/0357722 | A1 | 12/2015 | Sato | |
| 2016/0006164 | A1 | 1/2016 | Sato | |

FOREIGN PATENT DOCUMENTS

| | | | |
|---|---|---|---|
| JP | 2013-243011 | A | 12/2013 |
| JP | 2014-160591 | A | 9/2014 |
| JP | 2014-182957 | A | 9/2014 |
| JP | 2014-182958 | A | 9/2014 |
| WO | 2010/026824 | A1 | 3/2010 |

* cited by examiner

CRIMP TERMINAL

CROSS-REFERENCE TO RELATED APPLICATION(S)

The present application claims priority to and incorporates by reference the entire contents of Japanese Patent Application No. 2015-244886 filed in Japan on Dec. 16, 2015.

BACKGROUND OF THE INVENTION

1. Field of the Invention

The present invention relates to a crimp terminal.

2. Description of the Related Art

A crimp terminal is conventionally known including an electric wire connecting portion to be electrically connected to a core wire of an electric wire and a terminal connecting portion to be electrically connected to a counterpart terminal. In this crimp terminal, a coupling portion coupling the electric wire connecting portion and the terminal connecting portion is interposed therebetween. Japanese Patent Application Laid-open No. 2014-182957, Japanese Patent Application Laid-open No. 2014-182958, Japanese Patent Application Laid-open No. 2014-160591, and Japanese Patent Application Laid-open No. 2012-69449 disclose this kind of crimp terminals. This kind of crimp terminals is formed through a press process (cutting processing, bending processing, and the like) on a flat plate-shaped member. The plate-shaped member subjected to cutting processing includes a flat electric wire side plate-shaped portion that will be the electric wire connecting portion later by bending processing and the like, a flat terminal side plate-shaped portion that will be the terminal connecting portion later by bending processing and the like, and a flat coupling side plate-shaped portion that will be the coupling portion later by bending processing and the like. The electric wire side plate-shaped portion is formed as a U-shaped electric wire connecting portion including a bottom portion on which an electric wire is placed during crimping processing and two barrel pieces extending from both ends of the bottom portion so as to surround the electric wire by bending processing.

Some terminal connecting portions may be formed to have a box-shaped appearance such as female terminals. In this case, the terminal side plate-shaped portion is formed as the terminal connecting portion by forming two facing walls by bending processing and continuing bending processing and the like on the walls and the like. In this process, the two walls are bent in the respective same directions as the two barrel pieces of the U-shaped electric wire connecting portion. Given this situation, when the bending processing on the two walls and the bending processing on the two barrel pieces are simultaneously performed, bending processing on the coupling side plate-shaped portion can also be performed simultaneously with these pieces of bending processing, and two facing side walls of the coupling portion can be formed by the bending processing. However, when the bending processing of the two walls on the terminal side plate-shaped portion and the bending processing of the two barrel pieces on the electric wire side plate-shaped portion cannot be performed simultaneously, the coupling side plate-shaped portion is bent in such a manner as being dragged by one bending processing performed first of the two, and the coupling side plate-shaped portion is again bent in such a manner as being dragged by the following, other bending processing, whereby the two facing side walls of the coupling portion are formed. In this case, portions of the coupling side plate-shaped portion that will be the side walls later are pulled between the terminal side plate-shaped portion side and the electric wire side plate-shaped portion side during the first bending processing. Consequently, stress concentration occurs at these portions by a tensile force occurring therebetween.

SUMMARY OF THE INVENTION

In view of the foregoing circumstances, an object of the present invention is to provide a crimp terminal with reduced durability degradation.

In order to achieve the above mentioned object, a crimp terminal according to one aspect of the present invention includes a terminal connecting portion to be electrically connected to a counterpart terminal; an electric wire connecting portion to be electrically connected to an end of an electric wire placed on an inner wall face side by crimping processing; and a coupling portion that couples the terminal connecting portion and the electric wire connecting portion, wherein the electric wire connecting portion is sectioned into a bottom portion on which the end of the electric wire is placed during the crimping processing, a first barrel piece that is caused to extend from one end of the bottom portion to be wound around the end of the electric wire, and a second barrel piece that is caused to extend from another end of the bottom portion to be wound around the end of the electric wire, the electric wire connecting portion is formed with the first barrel piece and the second barrel piece facing each other by bending processing on both ends of a flat electric wire side plate-shaped portion that will be the electric wire connecting portion later after two facing walls are formed by bending processing on both ends of a flat terminal side plate-shaped portion that will be the terminal connecting portion later, the coupling portion is formed with one side wall connected to one of the walls and the first barrel piece and another side wall connected to another one of the walls and the second barrel piece by bending processing on both ends of a flat coupling side plate-shaped portion that will be the coupling portion later, the two side walls facing each other are formed by bending both ends of the coupling side plate-shaped portion in such a manner as being dragged by the bending processing on both ends of the terminal side plate-shaped portion and by bending both ends of the coupling side plate-shaped portion in such a manner as being dragged by the following bending processing on both ends of the electric wire side plate-shaped portion, and certain portions of the coupling side plate-shaped portion that will be the side walls later include at least one tensile force absorbing portion that absorbs a tensile force between a side of the terminal side plate-shaped portion and a side of the electric wire side plate-shaped portion occurring during the bending processing on both ends of the terminal side plate-shaped portion.

According to another aspect of the present invention, in the crimp terminal, it is preferable that the tensile force absorbing portion is formed in a bent shape stretching by the tensile force.

According to still another aspect of the present invention, in the crimp terminal, it is preferable that the tensile force absorbing portion has the bent shape of a bead shape or a rib shape protruding from an inner wall face side to an outer wall face side or from the outer wall face side to the inner wall face side at the certain portions and is caused to extend from at least partial free end at the certain portion toward the other certain portion.

According to still another aspect of the present invention, in the crimp terminal, it is preferable that the tensile force absorbing portion has a shape in which bending is released at the time of the end of the bending processing on both ends of the terminal side plate-shaped portion at earliest.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
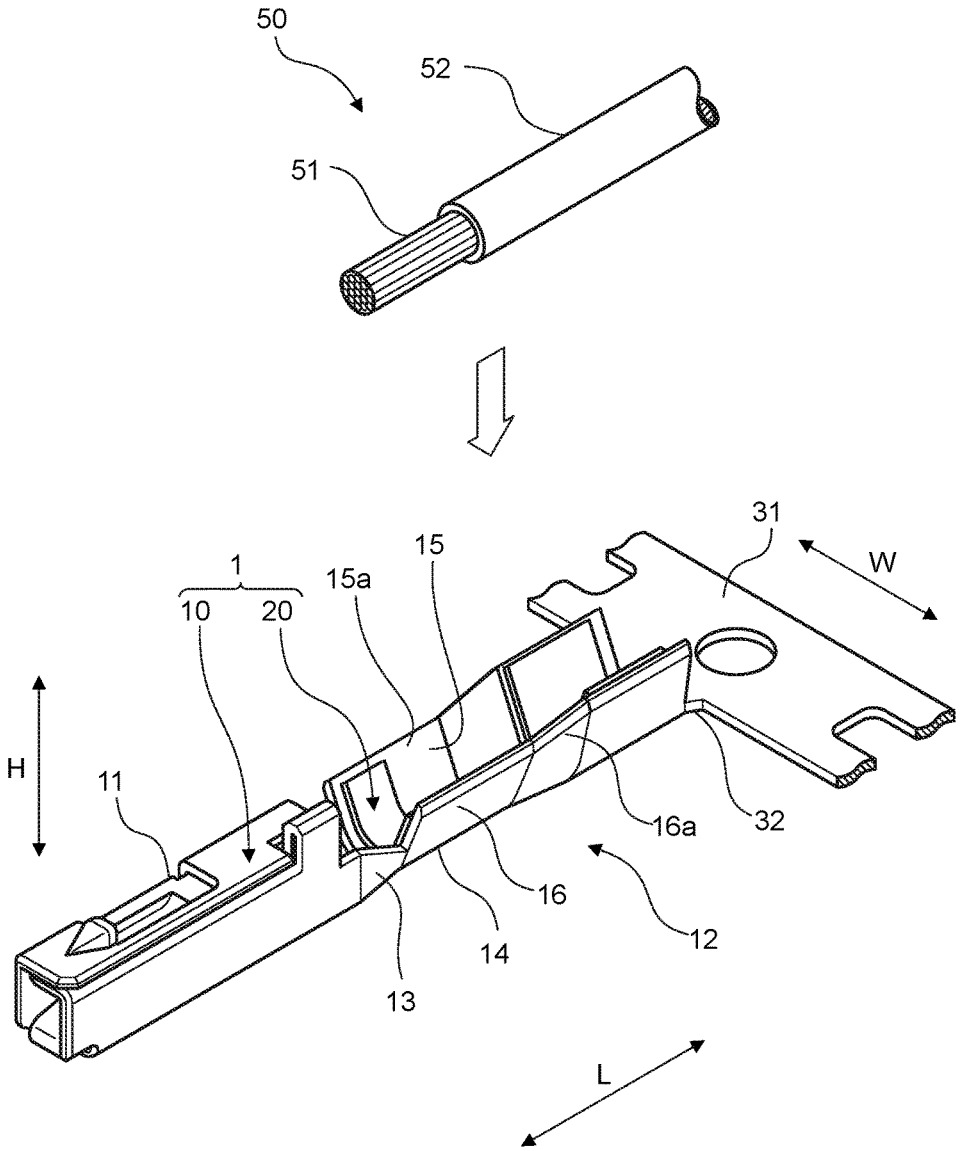
FIG. 1 is a perspective view of a crimp terminal of an embodiment illustrating a state before being connected to an electric wire.
Figure 2:
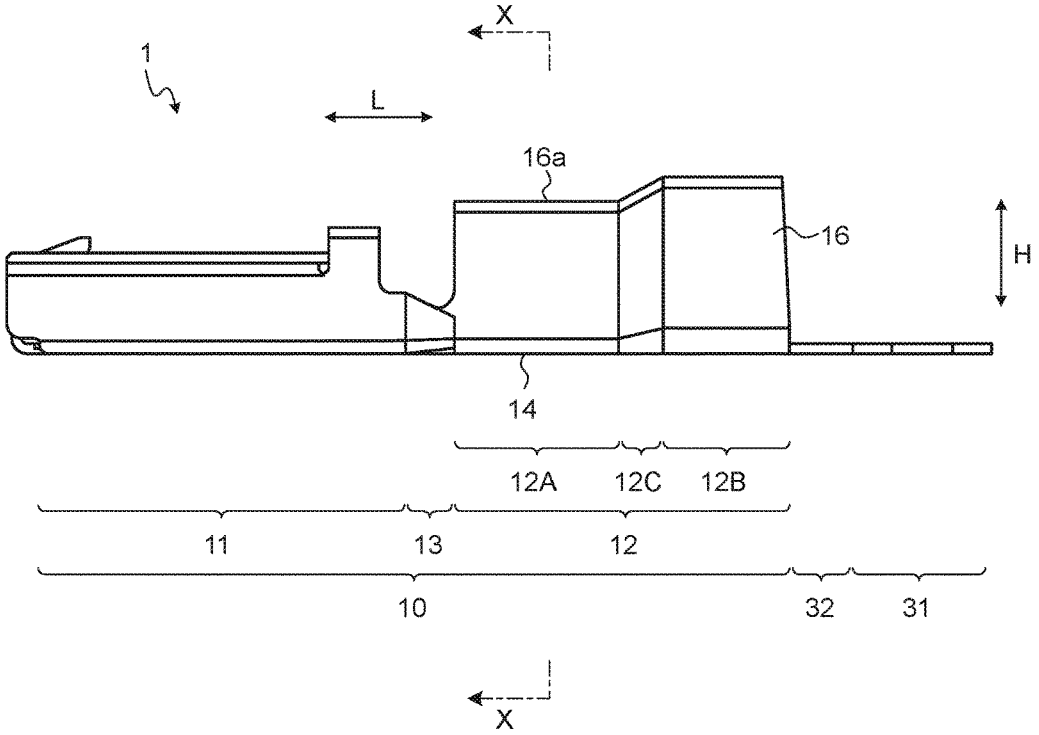
FIG. 2 is a side view of the crimp terminal of the embodiment illustrating a state in which an electric wire connecting portion is formed in a U shape.
Figure 3:
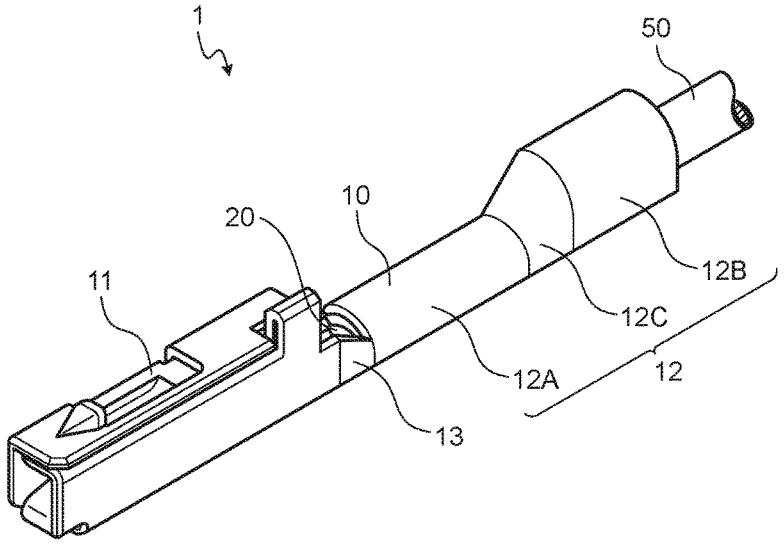
FIG. 3 is a perspective view of the crimp terminal after the completion of crimping in the embodiment.
Figure 4:
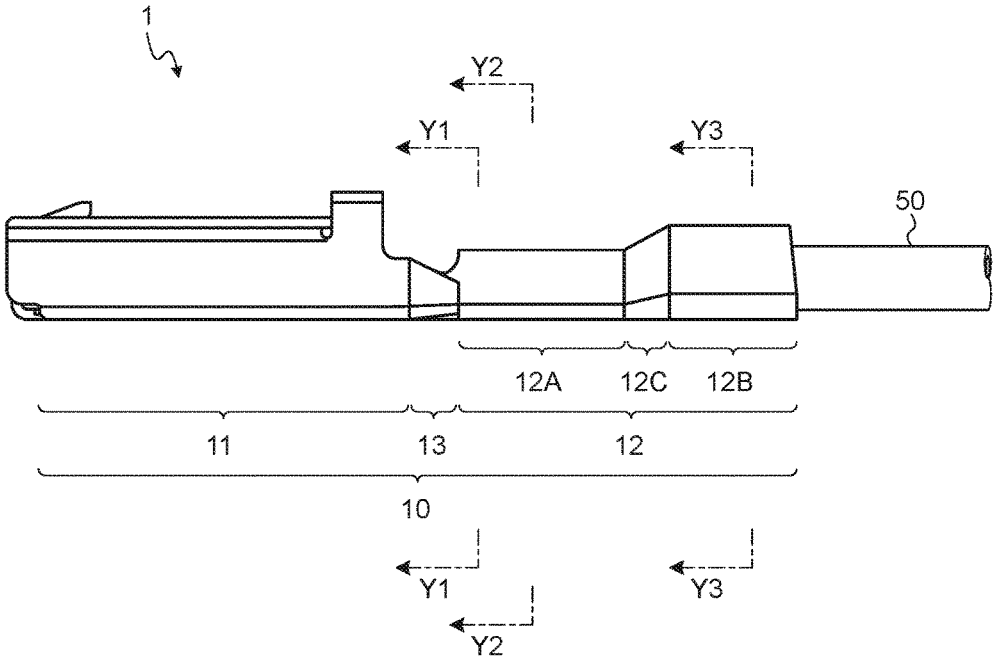
FIG. 4 is a side view of the crimp terminal after the completion of crimping in the embodiment.

The following describes an embodiment of a crimp terminal according to the present invention in detail based on the accompanying drawings. This embodiment does not limit this invention.

Embodiment

The following describes one embodiment of the crimp terminal according to the present invention based on FIG. 1 to FIG. 11.

Numeral 1 in FIG. 1 to FIG. 4 indicates the crimp terminal of the present embodiment. This crimp terminal 1 is electrically connected to an electric wire 50 and is electrically connected to a counterpart terminal (not illustrated) while being integrated with this electric wire 50. One end of the electric wire 50 has, to expose a core wire 51 thereof by a certain length, a sheath 52 peeled off to be removed by the length. The core wire 51 may be an aggregate of a plurality of elemental wires or a single wire such as a coaxial cable. The crimp terminal 1, to be electrically connected to the electric wire 50, is crimped onto the end of the electric wire 50 and is thereby electrically connected to the exposed core wire at the distal end (hereinafter, referred to simply as a "distal-end core wire") 51.

Specifically, the crimp terminal 1 includes a terminal metal fitting 10 and a water stop member 20.

Figure 5:
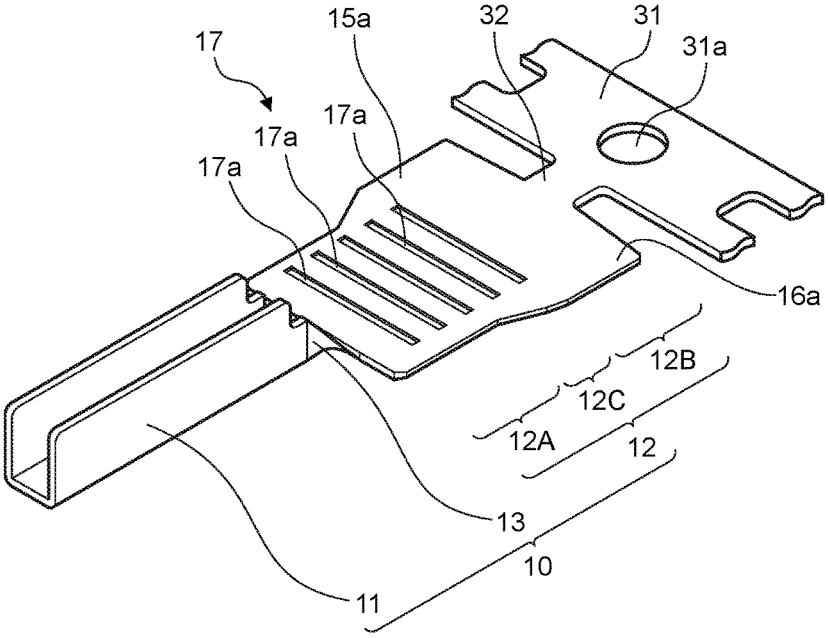
FIG. 5 is a perspective view of a terminal metal fitting of the crimp terminal of the embodiment illustrating a state before a water stop member is affixed.

The terminal metal fitting 10 is the main part of this exemplary crimp terminal 1. This terminal metal fitting 10 is formed into a certain shape that can be connected to the counterpart terminal and the electric wire 50 by performing punching processing, bending processing, and the like on a conductive metal plate (a copper plate, for example) as a base material. As illustrated in FIG. 5, this terminal metal fitting 10 includes a terminal connecting portion 11 to be electrically connected to the counterpart terminal and an electric wire connecting portion 12 to be electrically connected to the electric wire 50. The terminal connecting portion 11 and the electric wire connecting portion 12 are coupled to each other via a coupling portion 13 interposed therebetween.

The terminal metal fitting 10 may be a male terminal or a female terminal so long as the appearance of the terminal connecting portion 11 is formed in a box shape. The present embodiment provides a female terminal as an example.

A direction along which the counterpart terminal is connected with this crimp terminal 1 (an insertion direction), which is a longitudinal direction of the crimp terminal 1, is defined as a first direction L. For the parallel arrangement direction of this crimp terminal 1, which will be described later, the width direction of the crimp terminal is defined as a second direction W. A direction orthogonal to both the first direction L and the second direction W, which is the height direction of the crimp terminal 1, is defined as a third direction H.

The electric wire connecting portion 12 is first formed in one plate shape (FIG. 5 and FIG. 6), subjected to certain processing, which will be described later, and then formed to a U shape serving as a state immediately before the connection with the electric wire 50 (FIG. 1). This electric wire connecting portion 12 is crimped onto the end of the electric wire 50, with the end of the electric wire 50 placed thereon, by being wound around the electric wire 50, and thereby comes into contact with the distal-end core wire 51.

Figure 6:
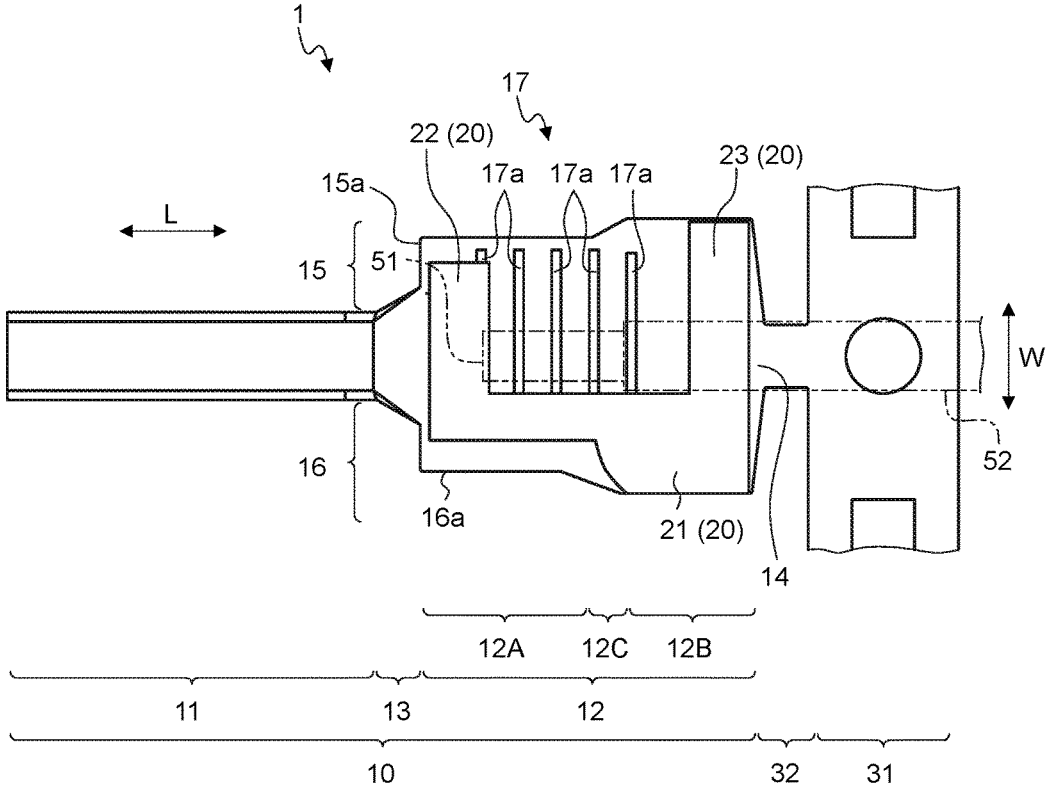
FIG. 6 is a top view of the terminal metal fitting of the crimp terminal of the embodiment illustrating a state after the water stop member has been affixed.

This electric wire connecting portion 12 can be sectioned into the area of a bottom portion 14, the area of a first barrel piece 15, and the area of a second barrel piece 16 (FIG. 1 and FIG. 6). The bottom portion 14 is a portion that will be the bottom wall of the U-shaped electric wire connecting portion 12 later, on which the end of the electric wire 50 is placed during crimping processing. The first and second barrel pieces 15 and 16 are portions that will be the side walls of the U-shaped electric wire connecting portion 12 later and are caused to extend on both ends in the second direction W of the bottom portion 14. For the U-shaped electric wire connecting portion 12, the first and second barrel pieces 15 and 16 thereof extend from both ends of the bottom portion 14 so as to surround the end of the electric wire 50.

The first barrel piece 15 and the second barrel piece 16 may be formed such that the respective distances from the bases on the bottom portion 14 to the end faces of tips 15*a* and 16*a* will be the same length or formed such that the distance will be longer in the other than in the one. The present embodiment exemplifies the former. The first barrel piece 15 and the second barrel piece 16 may be wound around the end of the electric wire 50 while overlapping each other or may be folded back toward the bottom portion 14 to crimp the tips 15*a* and 16*a* onto the end of the electric wire 50 (what is called the B type crimp, for example). The present embodiment provides the water stop member 20 as described below and uses the former form. The first barrel piece 15 and the second barrel piece 16 of the present embodiment are each formed as one piece with a coupling crimp portion 12C interposed between a core wire crimp portion 12A and a sheath crimp portion 12B described below. However, this crimp terminal 1 may be one in which the barrel piece of the core wire crimp portion 12A and the barrel piece of the sheath crimp portion 12B are arranged spaced apart from each other, that is, one in which the core wire crimp portion 12A and the sheath crimp portion 12B are coupled to each other via the coupling portion of the bottom portion 14 (not illustrated) alone.

The end of the electric wire 50 is inserted from a U-shaped opening (an opening formed in between the end faces of the respective tips 15*a* and 16*a*) of the electric wire connecting portion 12 into a U-shaped inner space. For this purpose, so as to make the end of the electric wire 50 easy to be inserted, in the electric wire connecting portion 12, the spacing between the first barrel piece 15 and the second barrel piece 16 becomes wider from the bottom portion 14 toward the opening (the tips 15*a* and 16*a*).

Furthermore, this electric wire connecting portion 12 can be sectioned into the area of the core wire crimp portion 12A, the area of the sheath crimp portion 12B, and the area of the coupling crimp portion 12C (FIG. 2 and FIG. 4 to FIG. 6). The core wire crimp portion 12A is a portion to be crimped onto the distal-end core wire 51 and is connected to the coupling portion 13. The sheath crimp portion 12B is a portion to be crimped onto the sheath 52 connected to the base of the exposed portion of the distal-end core wire 51. The coupling crimp portion 12C is a portion coupling the core wire crimp portion 12A and the sheath crimp portion 12B and to be crimped onto the end of the electric wire 50.

The electric wire connecting portion 12 is provided with a core wire holding area (hereinafter, referred to as a "serration area") 17 for holding the crimped distal-end core wire 51 on the inner wall face (the wall face on the side covering the electric wire 50) thereof (FIG. 5 and FIG. 6). The serration area 17 is arranged at least at the portion to be wound around the distal-end core wire 51 in the inner wall face of the electric wire connecting portion 12. This exemplary serration area 17 is formed to cover the distal-end core wire 51 on the whole. Specifically, the serration area 17 of the present embodiment arranges a plurality of recesses, a plurality of protrusions, or a combination of a plurality of recesses and projections in a rectangular shape and is for increasing the contact area between the electric wire connecting portion 12 and the distal-end core wire 51 through the recesses or the protrusions and increasing the contact strength therebetween. In this example, a plurality of recesses 17*a* form the rectangular serration area 17.

The electric wire connecting portion 12 and the distal-end core wire 51 are required to be electrically connected to each other. For this reason, the entry of water to the gap therebetween may degrade durability, which is unfavorable. When the electric wire connecting portion 12 and the distal-end core wire 51 are formed of different kinds of metallic materials having different ionization tendencies (copper and aluminum or the like), for example, the entry of water to the gap therebetween can corrode, in particular, the aluminum side therebetween. Given this situation, this crimp terminal 1 is provided with the water stop member 20 for suppressing the entry of water to the gap between the electric wire connecting portion 12 and the distal-end core wire 51 (FIG. 1 and FIG. 6). This water stop member 20 is formed in a sheet shape with an adhesive such as a modified acrylic-based adhesive as a main component. For the water stop member 20, one in which a sheet-shaped nonwoven fabric is impregnated with an adhesive to have an adhesive effect on both faces of the sheet is used, for example. When the electric wire connecting portion 12 and the core wire 51 are formed of a metallic material of the same type (copper or the like), for example, the water stop member 20 is not necessarily required to be provided.

The water stop member 20 is formed in a certain shape and is affixed to the inner wall face of the flat electric wire connecting portion 12 illustrated in FIG. 5. This exemplary water stop member 20 includes a first water stop portion 21, a second water stop portion 22, and a third water stop portion 23 (FIG. 6). The first water stop portion 21 is a part forming a water stop area at least at a part at which the first barrel piece 15 and the second barrel piece 16 overlap each other (that is, an overlap area) after the completion of crimping and suppresses the entry of water from the gap therebetween to the gap between the electric wire connecting portion 12 and the distal-end core wire 51. The second water stop portion 22 is a part forming a water stop area at least on the terminal connecting portion 11 side of the tip position of the distal-end core wire 51 inside the electric wire connecting portion 12 after the completion of crimping and is an area that suppresses the entry of water from the terminal connecting portion 11 side to the gap between the electric wire connecting portion 12 and the distal-end core wire 51. The third water stop portion 23 is a part forming a water stop area at least in between the inner wall face of the electric wire connecting portion 12 (specifically, the sheath crimp portion 12B) and the sheath 52 after the completion of crimping and is an area that suppresses the entry of water from the gap therebetween to the gap between the electric wire connecting portion 12 and the distal-end core wire 51. This water stop member 20 cuts off the communication between the end of the electric wire 50 and the outside by the electric wire connecting portion 12 and can thereby suppress the entry of water to the gap between the electric wire connecting portion 12 and the distal-end core wire 51.

Figure 7:
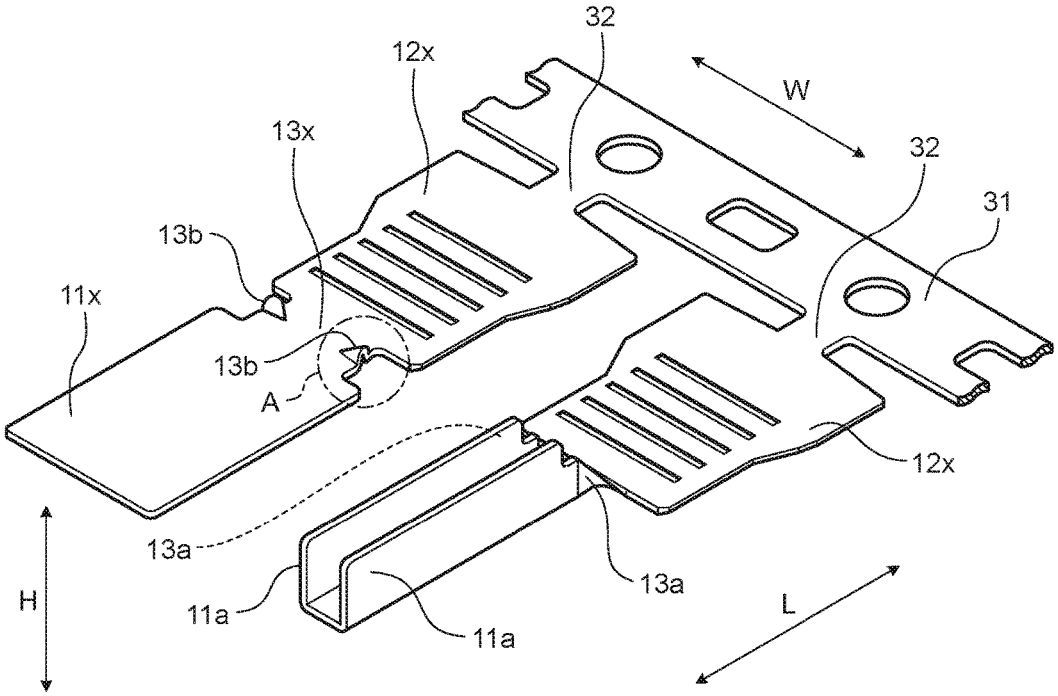
FIG. 7 is a perspective view illustrating states before and after bending processing on both ends of a terminal side plate-shaped portion.

The terminal metal fitting 10 described above is formed through a press process (cutting processing, bending processing, and the like) on one flat metallic plate-shaped member. The plate-shaped member subjected to cutting processing includes a flat and rectangular terminal side plate-shaped portion 11*x* that will be subjected to bending processing and the like to be the terminal connecting portion 11 later, a flat and rectangular electric wire side plate-shaped portion 12*x* that will be subjected to bending processing and the like to be the electric wire connecting portion 12 later, and a flat and rectangular coupling side plate-shaped portion 13*x* that will be subjected to bending processing to be the coupling portion 13 later (FIG. 7).

For the terminal side plate-shaped portion 11*x*, bending processing is performed on both ends in its second direction W, whereby two facing walls 11*a* are formed. The terminal connecting portion 11 is formed by the following bending processing and the like on the walls 11*a* and the like. The electric wire side plate-shaped portion 12*x* is formed with the serration area 17 and the like on the inner wall face side, and the water stop member 20 is then affixed thereto. Bending processing is performed on both ends in its second direction W with the water stop member 20 affixed thereto, whereby the electric wire side plate-shaped portion 12*x* is formed as the U-shaped electric wire connecting portion 12 including the bottom portion 14 on which the electric wire is placed during crimping processing and the two facing first and second barrel pieces 15 and 16 extending from both ends of the bottom portion 14 so as to surround the end of the electric wire 50. In the coupling side plate-shaped portion

13*x*, bending processing is performed on both ends in its second direction W, whereby two facing side walls 13*a* are formed. One side wall 13*a* connects one wall 11*a* and the first barrel piece 15. The other side wall 13*a* connects the other wall 11*a* and the second barrel piece 16.

In the terminal metal fitting 10 of the present embodiment, the one wall 11*a* and the first barrel piece 15 are bent in the same direction, whereas the other wall 11*a* and the second barrel piece 16 are bent in the same direction. In this terminal metal fitting 10, the bending processing on both ends of the terminal side plate-shaped portion 11*x* is performed before the process of affixing the water stop member 20 to the electric wire side plate-shaped portion 12*x*. In other words, in this terminal metal fitting 10, the bending processing on both ends of the terminal side plate-shaped portion 11*x* and the bending processing on both ends of the electric wire side plate-shaped portion 12*x* are not performed simultaneously. Consequently, in the coupling side plate-shaped portion 13*x*, the bending processing on both ends thereof is performed in such a manner as being dragged by the bending processing on both ends of the terminal side plate-shaped portion 11*x*, and the bending processing on both ends thereof is performed in such a manner as being dragged by the following bending processing on both ends of the electric wire side plate-shaped portion 12*x*, whereby the two side walls 13*a* are formed. In other words, in the coupling side plate-shaped portion 13*x*, the two walls 11*a* are formed by the bending processing on both ends of the terminal side plate-shaped portion 11*x*, the wall 11*a* sides on both ends are bent, the first and second barrel pieces 15 and 16 are then formed by the bending processing on both ends of the electric wire side plate-shaped portion 12*x*, and the first and second barrel pieces 15 and 16 sides on both ends are bent, whereby the two side walls 13*a* are formed. Given these circumstances, certain portions of the coupling side plate-shaped portion 13*x* that will be the side walls 13*a* later, during the first bending processing on the two walls 11*a*, are pulled between the wall 11*a* side that tends to bend and the electric wire side plate-shaped portion 12*x* side that tends to remain as the plate shape and is bent while being stretched by a tensile force during the process. Consequently, stress concentration occurs at the certain portions that will be the side walls 13*a* later. Such stress concentration may cause the strength degradation of the side walls 13*a*, degrade the durability of the coupling portion 13, and thus degrade the durability of the crimp terminal 1.

Figure 8:
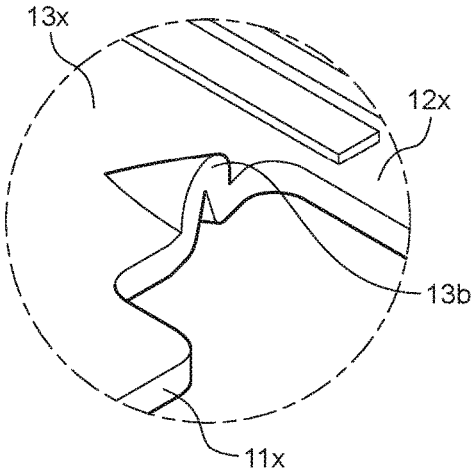
FIG. 8 is an enlarged view of Part A in FIG. 7.

Given these circumstances, the present embodiment includes, in the certain portions of the coupling side plate-shaped portion 13*x* that will be the side walls 13*a* later, at least one tensile force absorbing portion 13*b* that absorbs the tensile force between a side of the terminal side plate-shaped portion 11*x* and a side of the electric wire side plate-shaped portion 12*x* occurring during the bending processing on both ends of the terminal side plate-shaped portion 11*x* (FIG. 7 and FIG. 8). The tensile force absorbing portion 13*b* is formed before the bending processing. The tensile force absorbing portion 13*b* is formed in a bent shape stretching by the tensile force, for example. This kind of tensile force absorbing portion 13*b* may be formed as a bead-shaped or rib-shaped bent shape protruding from the inner wall face side to the outer wall face side or from the outer wall face side to the inner wall face side at the certain portions. This bent shape is caused to extend from at least partial free end at the certain portion toward the other certain portion. With this structure, when the bending processing on both ends of the terminal side plate-shaped portion 11*x* is performed, the tensile force absorbing portion 13*b* stretches by the tensile force occurring between the side of the terminal side plate-shaped portion 11*x* and the side of the electric wire side plate-shaped portion 12*x*. Consequently, the crimp terminal 1 of the present embodiment reduces a load caused by the tensile force therebetween, can thereby relax the stress concentration at the certain portions that will be the side walls 13*a* later, and can reduce the strength degradation of the side walls 13*a*. Consequently, by including the process of affixing the water stop member 20, this crimp terminal 1 reduces the strength degradation of the coupling portion 13 even when the bending processing on the terminal side plate-shaped portion 11*x* and the bending processing on the electric wire side plate-shaped portion 12*x* cannot be performed simultaneously and can thereby reduce durability degradation.

The tensile force absorbing portion 13*b* is preferably formed in a shape in which the bending is released at the time of the end of the bending processing on both ends of the terminal side plate-shaped portion 11*x* at the earliest. With this structure, the crimp terminal 1 of the present embodiment can appropriately reduce the load on the coupling side plate-shaped portion 13*x* by the tensile force during the bending processing, can thereby appropriately relax the stress concentration, and can obtain an effect of further reducing durability degradation.

The tensile force absorbing portion 13*b* can be provided even when the bending processing on both ends of the electric wire side plate-shaped portion 12*x* is performed before the bending processing on both ends of the terminal side plate-shaped portion 11*x*. Even in this case, the crimp terminal 1 can obtain an effect similar to that of the form described above.

Figure 9:
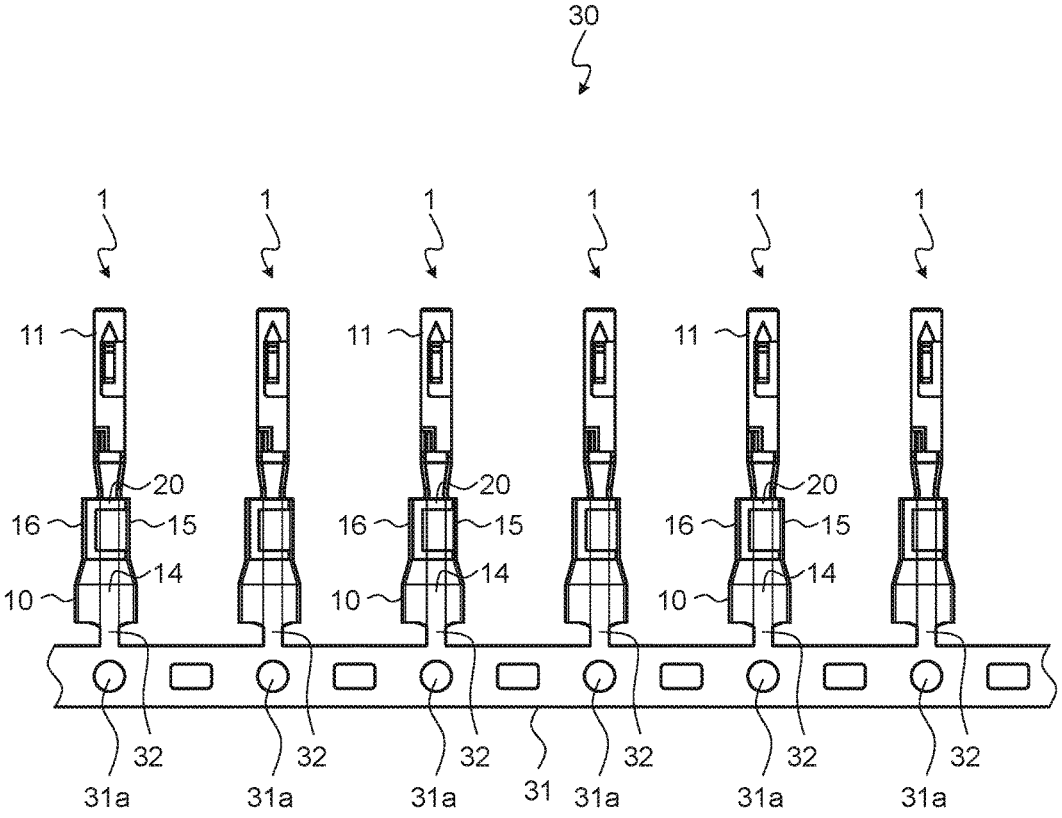
FIG. 9 is a diagram illustrating a terminal chained body.

The crimp terminal 1 having passed through the above process is formed as a chained body 30 (hereinafter, referred to as a "terminal chained body") in which a plurality of ones are arranged (FIG. 9). The terminal chained body 30 refers to an aggregate of a plurality of crimp terminals 1 that are arranged side by side equally spaced apart from each other and are connected in a chain shape while being directed in the same direction. In the terminal chained body 30, the one ends of all the crimp terminals 1 are connected by a coupling piece 31. The coupling piece 31 is formed in a rectangular plate shape, for example, and is arranged with a certain spacing relative to the respective electric wire connecting portions 12 of all the crimp terminals 1. The bottom portion 14 of the electric wire connecting portion 12 and the coupling piece 31 are connected via a rectangular plate-shaped connecting portion 32, for example, for each of the crimp terminals 1. The coupling piece 31 is formed with through holes (hereinafter, referred to as "terminal feeding holes") 31*a* for feeding the terminal chained body 30 to the crimp position of a terminal crimping device 100 equally spaced apart from each other in the direction of feeding the terminal chained body 30. The thus formed terminal chained body 30 is arranged in the terminal crimping device 100 in the form of being wound in a reel shape (not illustrated). The crimp terminals 1 are crimped onto the electric wires 50 and are then cut off from the terminal chained body 30.

The following describes the terminal crimping device 100.

Figure 10:
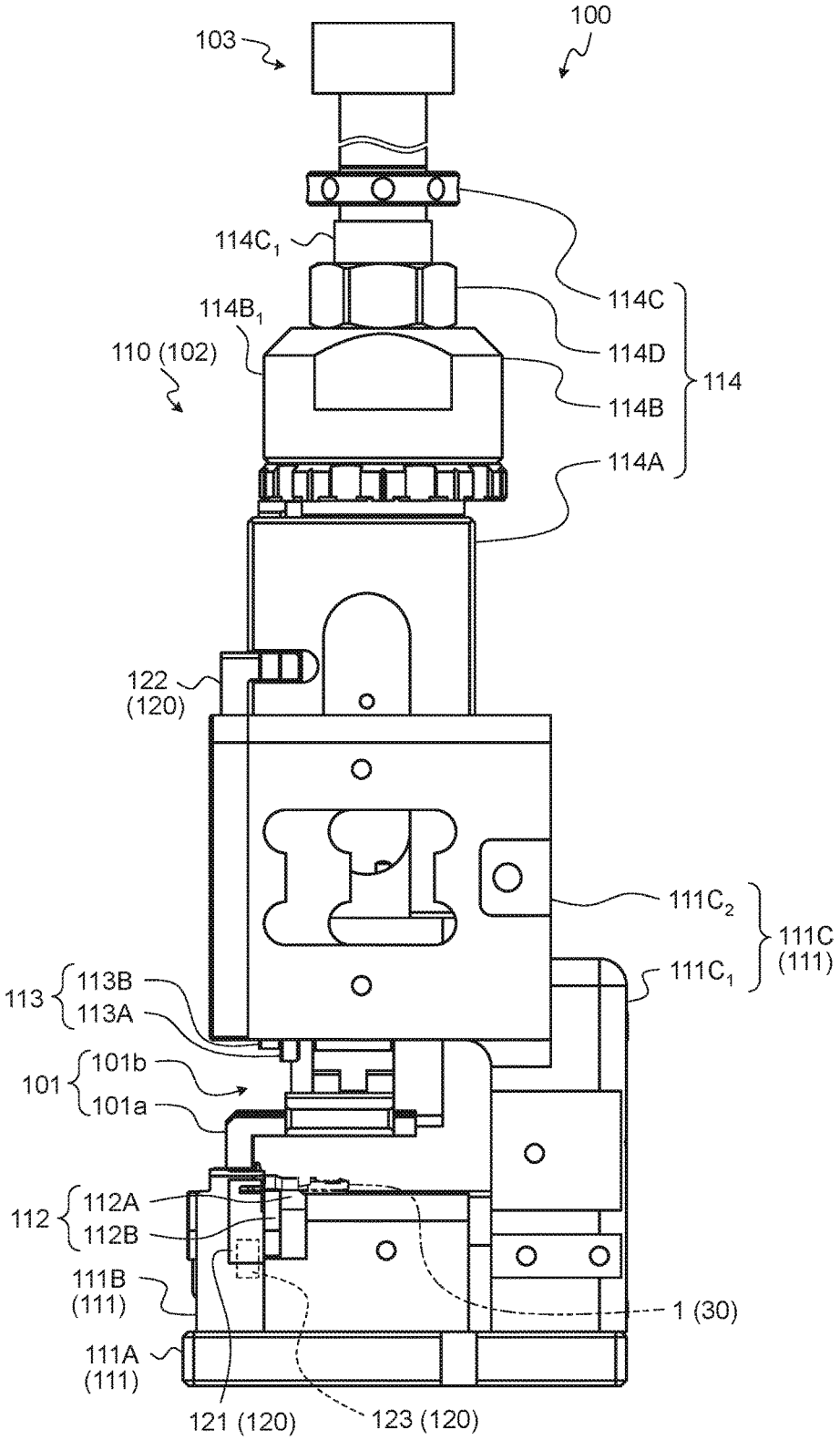
FIG. 10 is a diagram illustrating a terminal crimping device of the embodiment.

As illustrated in FIG. 10, the terminal crimping device 100 includes a terminal supply device 101 that feeds the crimp terminal 1 to a certain crimp position, a crimping device 102 that crimps the crimp terminal 1 onto the electric wire 50 at the crimp position, and a drive unit 103 that operates the terminal supply device 101 and the crimping device 102. The terminal supply device 101 and the crimping device 102 are a device called an applicator in this technical field.

The terminal supply device 101 pulls out the top crimp terminal 1 on the outer circumferential side of the terminal chained body 30 wound in a reel shape to feed the top crimp terminal 1 to the crimp position in succession. After completing the crimping of the top crimp terminal 1 onto the electric wire 50 and the cutting of the top crimp terminal 1 from the terminal chained body 30, the terminal supply device 101 feeds the new top crimp terminal 1 to the crimp position. This terminal supply device 101 repeats the operation in succession each time the crimping processing and the cutting processing are performed.

This terminal supply device 101 has a configuration well known in this technical field and includes a terminal feeding member 101*a* to be inserted into the terminal feeding holes 31*a* of the coupling piece 31 and a power transmission mechanism 101*b* that drives the terminal feeding member 101*a* by the power of the drive unit 103. The power transmission mechanism 101*b* is configured as a link mechanism operating in conjunction with the crimping operation (the up-and-down motion of a ram 114A and the like described below) of the crimping device 102. This exemplary terminal supply device 101 drives the terminal feeding member 101*a* in an up-and-down direction and a right-and-left direction in conjunction with the crimping operation of the crimping device 102 to feed the crimp terminal 1 to the crimp position.

The crimping device 102 performs the crimping of the fed crimp terminal 1 onto the electric wire 50 and the cutting of this crimp terminal 1 from the terminal chained body 30. For this purpose, this crimping device 102 includes a crimping machine 110 and a terminal cutting body 120.

The crimping machine 110 is a device that crimps the crimp terminal 1 fed to the crimp position onto the end of the electric wire 50, thereby crimping the crimp terminal 1 onto the electric wire 50. This exemplary crimping machine 110 crimps the first barrel piece 15 and the second barrel piece 16 of the crimp terminal 1 onto the distal-end core wire 51 and the sheath 52 of the electric wire 50, respectively, thereby crimping this crimp terminal 1 onto the electric wire 50. This crimping machine 110 includes a frame 111, a first mold 112 and a second mold 113 in pairs, and a power transmission mechanism 114.

The frame 111 includes a base 111A, an anvil support 111B, and a support 111C for the power transmission mechanism 114 (hereinafter, referred to as a "transmission unit support"). The base 111A is fixed onto a mounting base (not illustrated) on which the terminal crimping device 100 is mounted, for example. The anvil support 111B and the transmission unit support 111C are fixed onto the base 111A. The transmission unit support 111C is arranged behind (the right side in FIG. 10) and above (the upper side in FIG. 10) the anvil support 111B. Specifically, this transmission unit support 111C includes an erected portion 111$C_1$ erected from the base 111A upward behind the anvil support 111B and a ram support 111$C_2$ held above this erected portion 111$C_1$. The ram support 111$C_2$ is a support supporting the ram 114A described below and is arranged above the anvil support 111B with a certain spacing therefrom.

Figure 11:
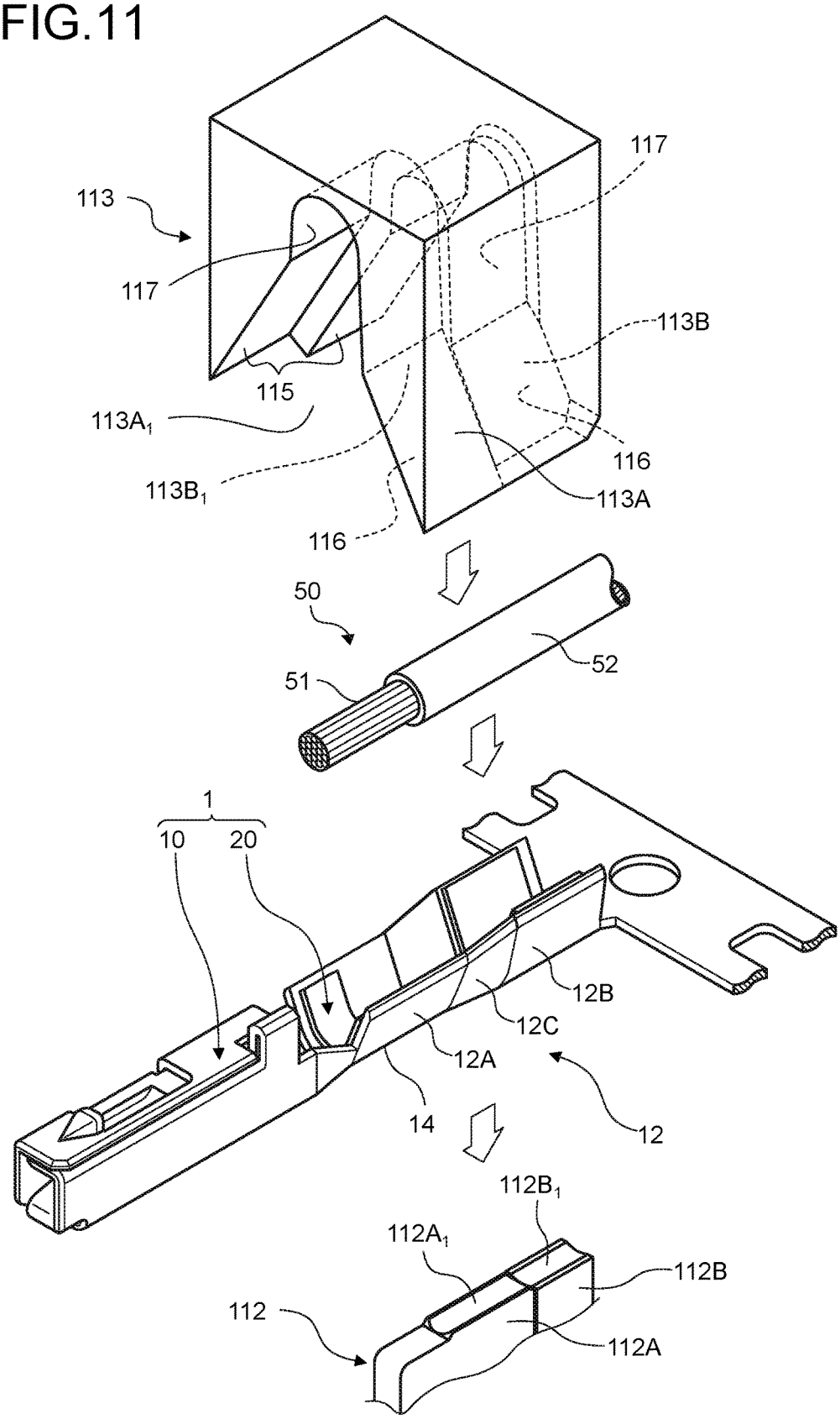
FIG. 11 is a perspective view illustrating first and second molds of the embodiment.

The first mold 112 and the second mold 113 are arranged spaced apart from each other in the up-and-down direction and form a crimp forming mold that pinches the crimp terminal 1 and the end of the electric wire 50 arranged therebetween to crimp the crimp terminal 1 onto the end of the electric wire 50 (FIG. 11). The first mold 112 is formed of two lower molds and includes a first anvil 112A and a second anvil 112B as the lower molds. The second mold 113 is formed of two upper molds and includes a first crimper 113A and a second crimper 113B as the upper molds. The first anvil 112A and the first crimper 113A are arranged facing each other in the up-and-down direction and narrow the gap therebetween to crimp the U-shaped core wire crimp portion 12A onto the distal-end core wire 51. The second anvil 112B and the second crimper 113B are arranged facing each other in the up-and-down direction and narrow the gap therebetween to crimp the U-shaped sheath crimp portion 12B onto the sheath 52.

The drive unit 103 transmits its power to the power transmission mechanism 114, thereby narrowing the gap between the first anvil 112A and the first crimper 113A and the gap between the second anvil 112B and the second crimper 113B during such crimping processing and widening the gap between the first anvil 112A and the first crimper 113A and the gap between the second anvil 112B and the second crimper 113B after the crimping processing. In this example, the second mold 113 is moved upward and downward relative to the first mold 112, thereby simultaneously moving the first crimper 113A and the second crimper 113B upward and downward relative to the first anvil 112A and the second anvil 112B, respectively. However, the first anvil 112A, the second anvil 112B, the first crimper 113A, and the second crimper 113B may be formed bodies individually formed; in this case, the drive unit 103 and the power transmission mechanism 114 may separately move the first crimper 113A and the second crimper 113B upward and downward. In this example, after the crimping of the core wire crimp portion 12A has started by the first anvil 112A and the first crimper 113A, the crimping of the sheath crimp portion 12B by the second anvil 112B and the second crimper 113B starts.

The power transmission mechanism 114 of the present embodiment transmits the power output from the drive unit 103 to the first crimper 113A and the second crimper 113B and includes the ram 114A, a ram bolt 114B, and a shank 114C as illustrated in FIG. 10.

The ram 114A is a movable member supported in such a manner as being freely movable upward and downward relative to the ram support 111$C_2$. The second mold 113 is fixed to this ram 114A. Given this situation, the first crimper 113A and the second crimper 113B can move upward and downward relative to the ram support 111$C_2$ integrally with the ram 114A. This ram 114A is formed in a rectangular parallelepipedal shape, for example. This ram 114A is formed with a female screw portion (not illustrated). This female screw portion is formed on the inner peripheral face of a hole in the up-and-down direction formed from the inside of the ram 114A toward an upper end face.

The ram bolt 114B includes a male screw portion (not illustrated) to be screwed with the female screw portion of the ram 114A. Given this situation, the ram bolt 114B can move upward and downward relative to the ram support 111$C_2$ integrally with the ram 114A. This ram bolt 114B includes a bolt head 114$B_1$ arranged above the male screw portion. The bolt head 114$B_1$ is formed with a female screw portion (not illustrated). The female screw portion is formed on the inner peripheral face of a hole in the up-and-down direction formed from the inside of the bolt head 114$B_1$ toward an upper end face.

The shank 114C is a cylindrical, hollow member and includes a male screw portion 114$C_1$ and a connection portion (not illustrated) at the respective ends. This male screw portion 114$C_1$ of the shank 114C is formed in the lower portion of the hollow member and is screwed with the female screw portion of the bolt head 114$B_1$ of the ram bolt 114B. Given this situation, the shank 114C can move upward and downward relative to the ram support 111$C_2$ integrally with the ram 114A and the ram bolt 114B. The connection portion is connected to the drive unit 103.

The drive unit 103 includes a driving source (not illustrated) and a power conversion mechanism (not illustrated) that converts the drive power of the driving source into power in the up-and-down direction. The connection portion of the shank 114C is coupled to the output shaft of the power conversion mechanism. Given this situation, the first crimper 113A and the second crimper 113B move upward and downward relative to the ram support 111$C_2$ integrally with the ram 114A, the ram bolt 114B, and the shank 114C by the output of the drive unit 103 (the output of the power conversion mechanism). Examples of the driving source include electric actuators such as electric motors, hydraulic actuators such as hydraulic cylinders, and pneumatic actuators such as air cylinders.

The relative position in the up-and-down direction of the first crimper 113A relative to the first anvil 112A and the relative position in the up-and-down direction of the second crimper 113B relative to the second anvil 112B can be changed by adjusting a screwed amount between the female screw portion of the bolt head 114$B_1$ and the male screw portion 114$C_1$ of the shank 114C. A nut 114D is screwed with the male screw portion 114$C_1$ of the shank 114C above the ram bolt 114B and serves as what is called a lock nut together with the female screw portion of the bolt head 114$B_1$. Given this situation, this nut 114D is tightened toward the ram bolt 114B after the completion of the adjustment of the relative positions, thereby enabling the first crimper 113A and the second crimper 113B to be fixed to the respective relative positions.

The first anvil 112A and the second anvil 112B are formed with recessed faces 112$A_1$ and 112$B_1$ recessed downward at the respective upper ends (FIG. 11). The recessed faces 112$A_1$ and 112$B_1$ are formed in an arc shape in accordance with the shapes of the respective bottom portions 14 of the U-shaped core wire crimp portion 12A and the U-shaped sheath crimp portion 12B. In this crimping machine 110, the recessed faces 112$A_1$ and 112$B_1$ serve as the crimp positions. As to the crimp terminal 1 fed with the bottom portion 14 directed downward, the bottom portion 14 of the core wire crimp portion 12A is placed on the recessed face 112$A_1$ at the upper end of the first anvil 112A, whereas the bottom portion 14 of the sheath crimp portion 12B is placed on the recessed face 112$B_1$ at the upper end of the second anvil 112B. The first mold 112 is supported by the anvil support 111B with the recessed faces 112$A_1$ and 112$B_1$ exposed upward.

The first crimper 113A and the second crimper 113B are formed with recessed portions 113$A_1$ and 113$B_1$, respectively, recessed upward (FIG. 11). The recessed portions 113$A_1$ and 113$B_1$ are arranged facing the respective recessed faces 112$A_1$ and 112$B_1$ of the first anvil 112A and the second anvil 112B, respectively, in the up-and-down direction. The recessed portions 113$A_1$ and 113$B_1$ each include first and second wall faces 115 and 116 facing each other and a third wall face 117 connecting the respective upper ends of the first and second wall faces 115 and 116. The recessed portions 113$A_1$ and 113$B_1$ each, while bringing the first to third wall faces 115, 116, and 117 into contact with the first barrel piece 15 and the second barrel piece 16, crimps the end of the electric wire 50 with the first barrel piece 15 and the second barrel piece 16 while winding the first barrel piece 15 and the second barrel piece 16 around the end of the electric wire 50. The recessed portions 113$A_1$ and 113$B_1$ are formed so as to enable such crimping operation to be performed.

The crimp terminal 1 subjected to the crimping processing by this crimping machine 110 is cut off from the coupling piece 31 by the terminal cutting machine 120. The terminal cutting machine 120 pinches and cuts the connecting portion 32 of the crimp terminal 1 fed to the crimp position by two terminal cutting units and performs the cutoff simultaneously with the progress of the crimping process. The terminal cutting machine 120 is arranged at the front (the left side in FIG. 10) of the second anvil 112B.

The terminal cutting machine 120 is well known in this technical field and includes a terminal cutting body 121, a pressing-down member 122, and an elastic member 123, for example. The terminal cutting body 121 is arranged so as to be able to slide on the front face of the second anvil 112B in the up-and-down direction. In this terminal cutting machine 120, the terminal cutting body 121 and the second anvil 112B are formed with respective terminal cutting units. The pressing-down member 122 is fixed to the ram 114A and moves upward and downward integrally with the ram 114A. This pressing-down member 122 is arranged above the terminal cutting body 121 and descends to press down the terminal cutting body 121. The elastic member 123 applies an upward biasing force to the terminal cutting body 121 and is formed of a spring or the like. When a pressing-down force from the pressing-down member 122 is released, this elastic member 123 returns the terminal cutting body 121 to an initial position in the up-and-down direction. In this terminal cutting machine 120, the pressing-down member 122 descends along with the descending of the second mold 113 during the crimping processing and presses down the terminal cutting body 121, thereby cutting the connecting portion 32 by the respective terminal cutting units and cutting off the crimp terminal 1 from the terminal chained body 30.

In the crimp terminal according to the embodiments, when the bending processing on both ends of the terminal side plate-shaped portion is performed, the tensile force absorbing portion stretches by the tensile force occurring between the side of the terminal side plate-shaped portion and the side of the electric wire side plate-shaped portion. Consequently, this crimp terminal reduces a load caused by the tensile force therebetween, can thereby relax the stress concentration at the certain portions that will be the side walls later, and can reduce the strength degradation of the side walls. Consequently, this crimp terminal reduces the strength degradation of the coupling portion even when the bending processing on the terminal side plate-shaped portion and the bending processing on the electric wire side plate-shaped portion cannot be performed simultaneously, and can thereby reduce durability degradation.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A crimp terminal comprising:

a terminal connecting portion to be electrically connected to a counterpart terminal;

an electric wire connecting portion to be electrically connected to an end of an electric wire placed on an inner wall face side by crimping processing; and a coupling portion that couples the terminal connecting portion and the electric wire connecting portion, wherein the electric wire connecting portion is sectioned into a bottom portion on which the end of the electric wire is placed during the crimping processing, a first barrel piece that is caused to extend from one end of the bottom portion to be wound around the end of the electric wire, and a second barrel piece that is caused to extend from another end of the bottom portion to be wound around the end of the electric wire, the electric wire connecting portion is formed with the first barrel piece and the second barrel piece facing each other by bending processing on both ends of a flat electric wire side plate-shaped portion that will be the electric wire connecting portion later after two facing walls are formed by bending processing on both ends of a flat terminal side plate-shaped portion that will be the terminal connecting portion later, the coupling portion is formed with one side wall connected to one of the walls and the first barrel piece and another side wall connected to another one of the walls and the second barrel piece by bending processing on both ends of a flat coupling side plate-shaped portion that will be the coupling portion later, the two side walls facing each other are formed by bending both ends of the coupling side plate-shaped portion in such a manner as being dragged by the bending processing on both ends of the terminal side plate-shaped portion and by bending both ends of the coupling side plate-shaped portion in such a manner as being dragged by the following bending processing on both ends of the electric wire side plate-shaped portion, and certain portions of the coupling side plate-shaped portion that will be the side walls later include at least one tensile force absorbing portion which, prior to forming the two side walls, extends in a direction perpendicular to a plane of the electric wire side plate-shaped portion and absorbs a tensile force between a side of the terminal side plate-shaped portion and a side of the electric wire side plate-shaped portion occurring during the bending processing on both ends of the terminal side plate-shaped portion.

2. The crimp terminal according to claim 1, wherein the tensile force absorbing portion is formed in a bent shape stretching by the tensile force.

3. The crimp terminal according to claim 2, wherein the tensile force absorbing portion has the bent shape of a bead shape or a rib shape protruding from an inner wall face side to an outer wall face side or from the outer wall face side to the inner wall face side at the certain portions and is caused to extend from at least partial free end at the certain portion toward the other certain portion.

4. The crimp terminal according to claim 2, wherein the tensile force absorbing portion has a shape in which bending is released at the time of the end of the bending processing on both ends of the terminal side plate-shaped portion at earliest.

5. The crimp terminal according to claim 3, wherein the tensile force absorbing portion has a shape in which bending is released at the time of the end of the bending processing on both ends of the terminal side plate-shaped portion at earliest.

6. The crimp terminal according to claim 1, wherein the tensile force absorbing portion is substantially triangular in shape.

* * * * *